US010766265B2

(12) United States Patent
Tokisawa et al.

(10) Patent No.: US 10,766,265 B2
(45) Date of Patent: Sep. 8, 2020

(54) INK JET PRINTING APPARATUS

(71) Applicant: CANON KABUSHIKI KAISHA, Tokyo (JP)

(72) Inventors: Toshiaki Tokisawa, Kawasaki (JP); Junya Kosuge, Kawasaki (JP); Kyoshiro Okude, Kawasaki (JP); Yumi Mukoyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/293,204

(22) Filed: Mar. 5, 2019

(65) Prior Publication Data

US 2019/0299631 A1 Oct. 3, 2019

(30) Foreign Application Priority Data

Mar. 30, 2018 (JP) ..... 2018-066376

(51) Int. Cl.
*B41J 2/175* (2006.01)
*B41J 2/21* (2006.01)

(52) U.S. Cl.
CPC ..... *B41J 2/17523* (2013.01); *B41J 2/2121* (2013.01)

(58) Field of Classification Search
CPC .... B41J 2/175; B41J 2/17566; B41J 2/17523; B41J 2/1752; B41J 2/17596
USPC ..... 347/84, 85
See application file for complete search history.

(56) References Cited

U.S. PATENT DOCUMENTS 9,162,507 B2 10/2015 Tanaka et al.
10,357,977 B2 * 7/2019 Mukoyama ..... B41J 2/17596
2011/0050794 A1 * 3/2011 Koike ..... B41J 2/125 347/22

FOREIGN PATENT DOCUMENTS

JP 2011-240628 A 12/2011

* cited by examiner

*Primary Examiner* — An H Do
(74) *Attorney, Agent, or Firm* — Venable LLP

(57) ABSTRACT

An object of the present invention is to provide an ink jet printing apparatus whose compactness is improved. The ink jet printing apparatus includes: a print head; an ink tank for each ink color; an ink flow path plate for each ink color having a supply flow path that guides the ink supplied from the ink tank to the print head and a recovery flow path that guides the ink recovered from the print head to the ink tank; a flow path concentration plate in which the supply flow path and the recovery flow path for each ink color are concentrated and which guides the ink between the ink flow path plate and the print head; and one or a plurality of function parts provided within a range of a space demarcated by the ink flow path plate and the flow path concentration plate.

20 Claims, 14 Drawing Sheets

INK JET PRINTING APPARATUS

BACKGROUND OF THE INVENTION

Field of the Invention

The present invention relates to an ink jet printing apparatus.

Description of the Related Art

There is an ink jet printing apparatus that performs a printing operation while circulating ink by supplying ink from a tank to a print head and recovering ink from the print head to the tank.

Japanese Patent Laid-Open No. 2011-240628 has disclosed an ink jet printing apparatus provided with a supply path for supplying ink from a storage tank to a print head and a recovery path for recovering ink from the print head to the storage tank.

SUMMARY OF THE INVENTION

Downsizing of an ink jet printing apparatus is demanded. In order to downsize an ink jet printing apparatus, it is necessary to improve compactness of an ink supply unit by appropriately configuring a flow path relating to ink, which connects a tank and a print head, and appropriately arranging the flow path and function parts acting on the flow path.

However, Japanese Patent Laid-Open No. 2011-240628 has not disclosed the configuration or arrangement relating to the flow path and the function parts for improving the compactness such as this.

Consequently, in view of the above-described problem, an object of the present invention is to provide an ink jet printing apparatus whose compactness is improved by appropriately configuring a flow path relating to ink, which connects a tank and a print head, and appropriately arranging the flow path and function parts acting on the flow path.

The present invention is an ink jet printing apparatus including: a print head that ejects ink; an ink tank for each ink color that stores the ink; an ink flow path plate for each ink color provided under the ink tank in the direction of gravity and having a supply flow path that guides the ink supplied from the ink tank to the print head and a recovery flow path that guides the ink recovered from the print head to the ink tank; a flow path concentration plate in which the supply flow path and the recovery flow path for each ink color are concentrated and which guides the ink between the ink flow path plate and the print head; and one or a plurality of function parts provided within a range of a space demarcated by the ink flow path plate and the flow path concentration plate having an inclination with respect to the ink flow path plate, and which acts on at least one of the supply flow path and the recovery flow path inside the ink flow path plate.

Further features of the present invention will become apparent from the following description of exemplary embodiments with reference to the attached drawings.

DESCRIPTION OF THE EMBODIMENTS

In the following, embodiments of the present invention are explained with reference to the drawings. However, the following embodiments are not intended to limit the present invention and all combinations of features explained in the present embodiments are not necessarily indispensable to the solution of the present invention. Explanation is given by attaching the same symbol to the same configuration. The relative arrangement, shapes, and so on of components described in the embodiments are merely exemplary and not intended to limit the scope of the invention only to those.

First Embodiment

Figure 1:
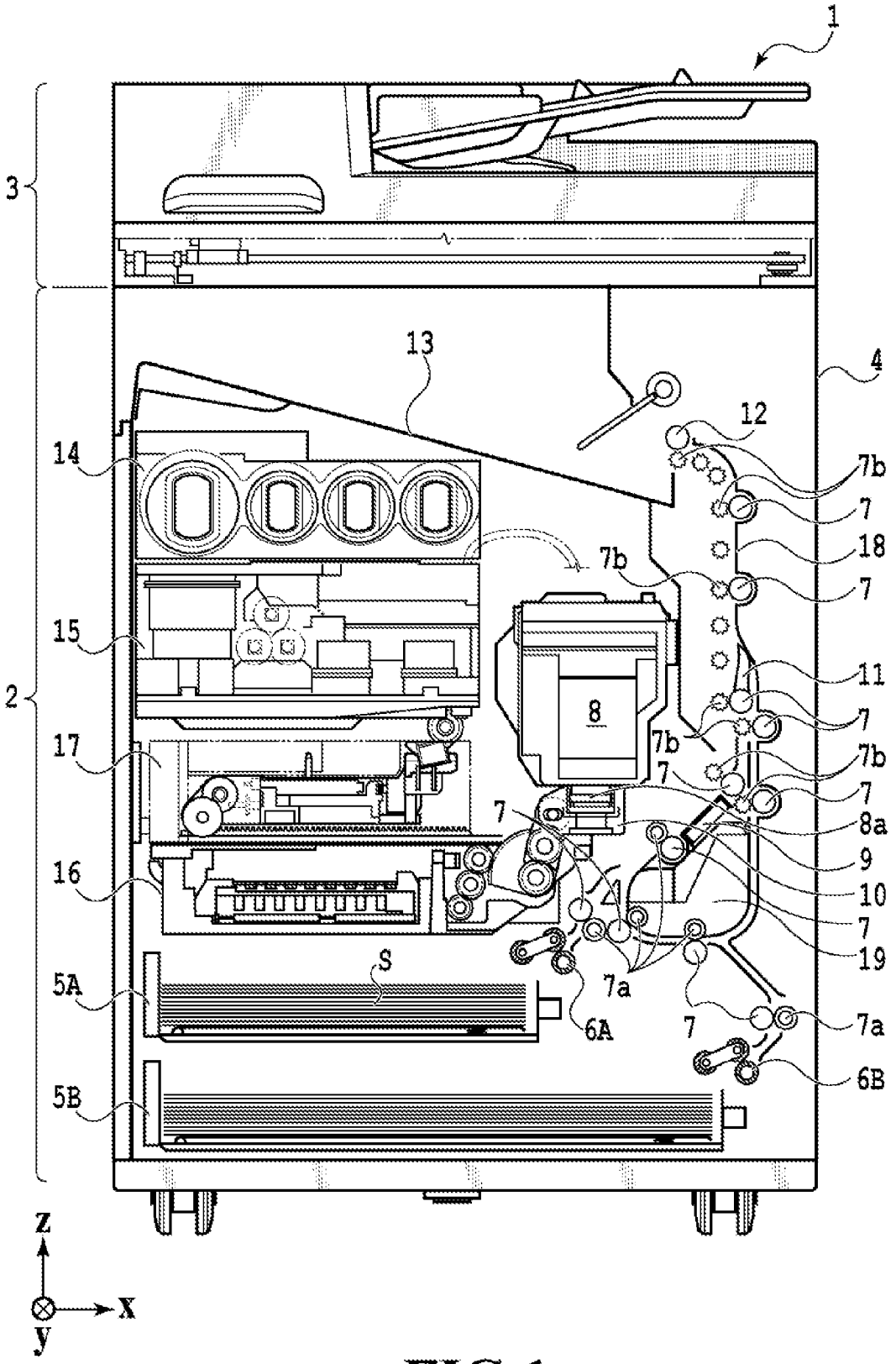
FIG. 1 is a diagram in a case where a printing apparatus is in a standby state.

FIG. 1 is an internal configuration diagram of an ink jet printing apparatus 1 (hereinafter, printing apparatus 1) used in the present embodiment. In FIG. 1, the x-direction indicates the horizontal direction, the y-direction (direction perpendicular to the paper surface) indicates the direction in which ejection ports are arrayed in a print head 8, to be described later, and the z-direction indicates the vertical direction (direction of gravity), respectively.

The printing apparatus 1 is a multi function printer including a print unit 2 and a scanner unit 3 and capable of performing a variety of kinds of processing relating to the printing operation and the reading operation by the print unit 2 and the scanner unit 3 individually, or in an interlocking manner of the print unit 2 and the scanner unit 3. The scanner unit 3 includes an ADF (Auto Document Feeder) and an FBS (Flat Bed Scanner) and is capable of reading of a document automatically fed by the ADF and reading (scanning) of a document placed on a document table of the FBS by a user. The present embodiment is the multi function printer having both the print unit 2 and the scanner unit 3, but the multi function printer may be an aspect in which the scanner unit 3 is not included. FIG. 1 shows a case where the printing apparatus 1 is in a standby state where the printing apparatus 1 is performing neither the printing operation nor the reading operation.

In the print unit 2, at the bottom in the vertically downward direction of a casing 4, a first cassette 5A and a second cassette 5B for storing a printing medium (cut sheet) S are installed in an attachable and detachable manner. In the first cassette 5A, comparatively small printing media up to the A4 size, and in the second cassette 5B, comparatively large printing media up to the A3 size are stored in a piled-up manner. In the vicinity of the first cassette 5A, a first feed unit 6A for feeding stored printing media by separating one by one is provided. Similarly, in the vicinity of the second cassette 5B, a second feed unit 6B is provided. In a case where the printing operation is performed, the printing medium S is selectively fed from one of the cassettes.

A conveyance roller 7, a discharge roller 12, a pinch roller 7*a*, a spur 7*b*, a guide 18, an inner guide 19, and a flapper 11 are conveyance mechanisms for guiding the printing medium S in a predetermined direction. The conveyance roller 7 is arranged on the upstream side and on the downstream side of the print head 8 and is a drive roller that is driven by a conveyance motor, not shown schematically. The pinch roller 7*a* is a follower roller that nips and rotates the printing medium S together with the conveyance roller 7. The discharge roller 12 is arranged on the downstream side of the conveyance roller 7 and is a drive roller that is driven by a conveyance motor, not shown schematically. The spur 7*b* sandwiches and conveys the printing medium S together with the conveyance roller 7 arranged on the downstream side of the print head 8 and the discharge roller 12.

The guide 18 is provided in the conveyance path of the printing medium S and guides the printing medium S in a predetermined direction. The inner guide 19 is a member extending in the y-direction and has a curved side surface, and guides the printing medium S along the side surface. The flapper 11 is a member for switching directions in which the printing medium S is conveyed at the time of the both-side printing operation. A discharge tray 13 is a tray for loading and holding the printing medium S for which the printing operation has been completed and which is discharged by the discharge roller 12.

The print head 8 of the present embodiment is a color ink jet print head of full line type and in which a plurality of ejection ports from which ink is ejected in accordance with print data is arrayed along the y-direction in FIG. 1 so as to correspond to the width of the printing medium S. In a case where the print head 8 is at the standby position, an ejection port surface 8*a* of the print head 8 faces in the vertically downward direction and is capped by a cap unit 10 as shown in FIG. 1. In a case where the printing operation is performed, by a print controller 202, to be described later, the direction of the print head 8 is changed so that the ejection port surface 8*a* faces a platen 9. The platen 9 is configured by a flat plate extending in the y-direction and supports the printing medium S from the rear side, for which the printing operation is performed by the print head 8. The movement of the print head 8 from the standby position to the printing position will be described later in detail.

An ink tank unit 14 stores four color inks to be supplied to the print head 8, respectively. An ink supply unit 15 is provided on the way in the flow path connecting the ink tank unit 14 and the print head 8 and adjusts the pressure and the amount of flow of the ink within the print head 8 to an appropriate range. In the present embodiment, a circulation-type ink supply system is adopted and the ink supply unit 15 adjusts the pressure of the ink supplied to the print head 8 and the amount of flow of the ink recovered from the print head 8 to an appropriate range.

A maintenance unit 16 includes the cap unit 10 and a wiping unit 17 and performs the maintenance operation for the print head 8 by causing these units to operate at predetermined timing.

Figure 2:
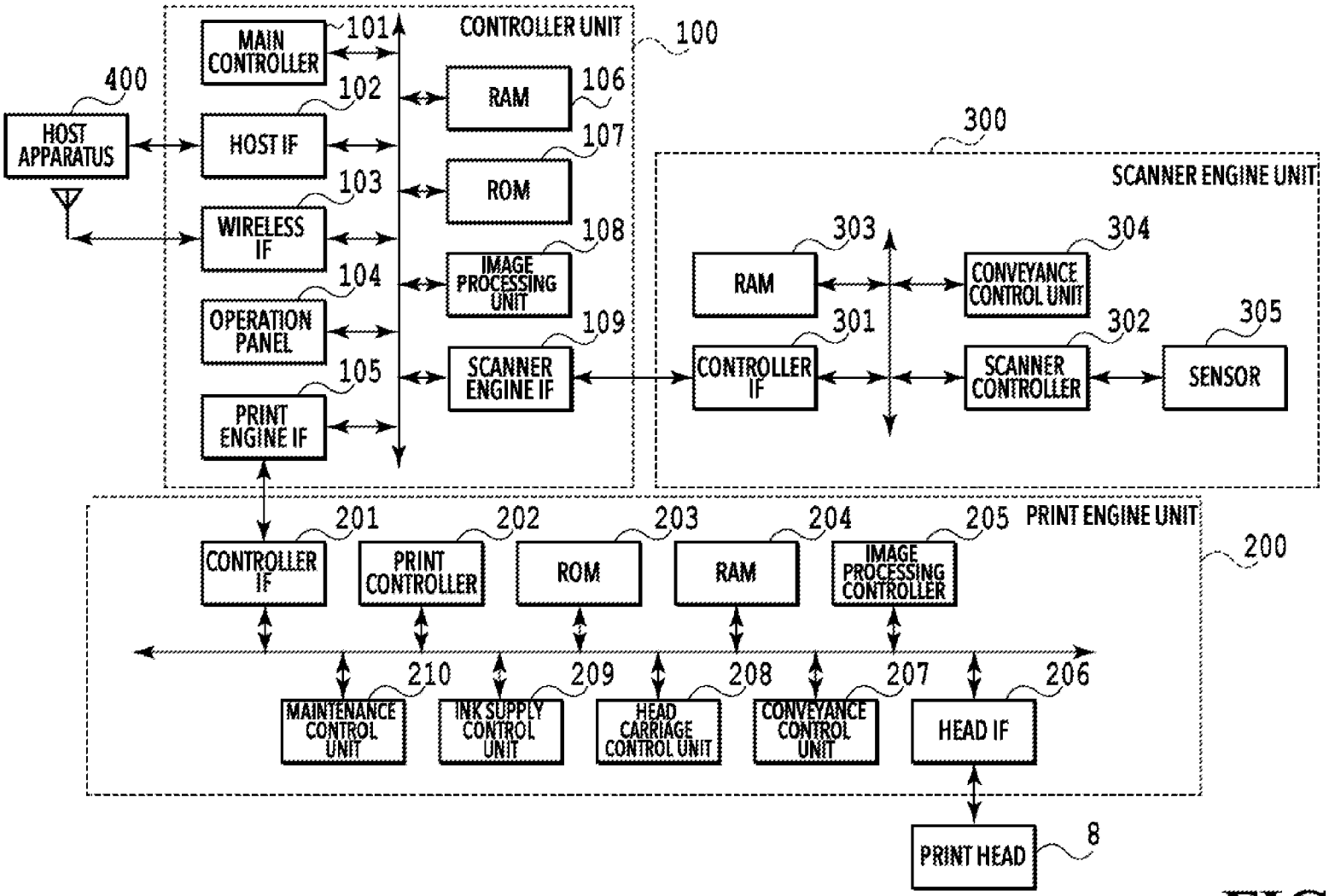
FIG. 2 is a control configuration diagram of the printing apparatus.

FIG. 2 is a block diagram showing a control configuration in the printing apparatus 1. The control configuration mainly includes a print engine unit 200 configured to centralizedly control the print unit 2, a scanner engine unit 300 configured to centralizedly control the scanner unit 3, and a controller unit 100 configured to centralizedly control the entire printing apparatus 1. The print controller 202 controls various mechanisms of the print engine unit 200 in accordance with instructions of a main controller 101 of the controller unit 100. Various mechanisms of the scanner engine unit 300 are controlled by the main controller 101 of the controller unit 100. In the following, details of the control configuration are explained.

In the controller unit 100, the main controller 101 including a CPU controls the entire printing apparatus 1 by using a RAM 106 as a work area in accordance with programs and various parameters stored in a ROM 107. For example, in a case where a print job is input from a host apparatus 400 via a host I/F 102 or a wireless I/F 103, predetermined image processing is performed for image data received by an image processing unit 108 in accordance with instructions of the main controller 101. Then, the main controller 101 transmits the image data for which image processing has been performed to the print engine unit 200 via a print engine I/F 105.

The printing apparatus 1 may acquire image data from the host apparatus 400 via wireless communication or wired communication or may acquire image data from an external storage device (USB memory and the like) connected to the printing apparatus 1. The communication method that is made use of for wireless communication or wired communication is not limited. For example, as the communication method that is made use of for wireless communication, it is possible to apply Wi-Fi (Wireless Fidelity) (registered trademark) and Bluetooth (registered trademark). Further, as the communication method that is made use of for wired communication, it is possible to apply USB (Universal Serial Bus) and the like. Furthermore, for example, in a case where a read command is input from the host apparatus 400, the main controller 101 transmits this command to the scanner unit 3 via a scanner engine I/F 109.

An operation panel 104 is a mechanism for a user to input and output for the printing apparatus 1. It is possible for a user to give instructions as to the operation, such as copy and scan, to set a printing mode, to recognize information on the printing apparatus 1, and so on via the operation panel 104.

In the print engine unit 200, the print controller 202 including a CPU controls various mechanisms included in the print unit 2 by using a RAM 204 as a work area in accordance with programs and various parameters stored in a ROM 203. In a case where various commands and image data are received via a controller I/F 201, the print controller 202 temporarily stores them in the RAM 204. The print controller 202 causes an image processing controller 205 to convert the saved image data into print data so that the print head 8 can make use of for the printing operation. In a case where print data is generated, the print controller 202 causes the print head 8 to perform the printing operation based on the print data via a head I/F 206. At this time, the print controller 202 conveys the printing medium S by driving the feed units 6A and 6B, the conveyance roller 7, the discharge roller 12, and the flapper 11 shown in FIG. 1 via a conveyance control unit 207. In accordance with instructions of the print controller 202, the printing operation by the print head 8 is performed in an interlocking manner with the conveyance operation of the printing medium S and thus printing processing is performed.

A head carriage control unit 208 changes the direction and position of the print head 8 in accordance with the operating state, such as the maintenance state and the printing state, of the printing apparatus 1. An ink supply control unit 209 controls the ink supply unit 15 so that the pressure of the ink to be supplied to the print head 8 is adjusted within an appropriate range. A maintenance control unit 210 controls the operation of the cap unit 10 and the wiping unit 17 in the maintenance unit 16 at the time of performing the maintenance operation for the print head 8.

In the scanner engine unit 300, the main controller 101 controls hardware resources of a scanner controller 302 by using the RAM 106 as a work area in accordance with programs and various parameters stored in the ROM 107. Due to this, various mechanisms included in the scanner unit 3 are controlled. For example, by the main controller 101 controlling the hardware resources within the scanner controller 302 via a controller I/F 301, a document mounted on the ADF by a user is conveyed via a conveyance control unit 304 and read by a sensor 305. Then, the scanner controller 302 saves the read image data in a RAM 303. It is possible for the print controller 202 to cause the print head 8 to perform the printing operation based on the image data read by the scanner controller 302 by converting the image data acquired as described above into print data.

Figure 3:
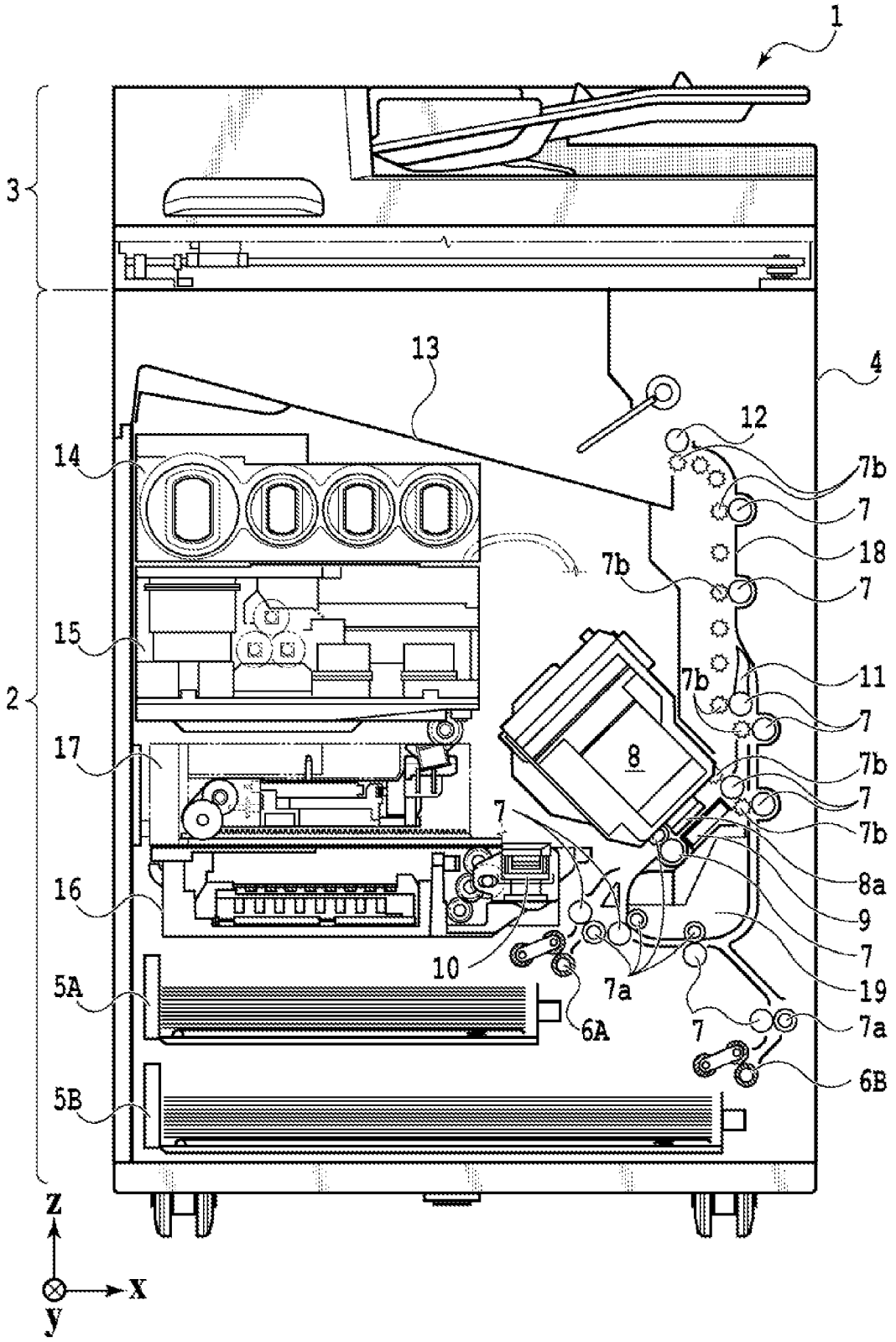
FIG. 3 is a diagram in a case where the printing apparatus is in a printing state.

FIG. 3 shows a case where the printing apparatus 1 is in the printing state. Compared to the standby state shown in FIG. 1, the cap unit 10 separates from the ejection port surface 8*a* of the print head 8 and the ejection port surface 8*a* faces the platen 9. In the present embodiment, the plane of the platen 9 is inclined about 45 degrees with respect to the horizontal direction and the ejection port surface 8*a* of the print head 8 at the printing position is also inclined about 45 degrees with respect to the horizontal direction so that the distance from the platen 9 is kept constant.

At the time of moving the print head 8 from the standby position shown in FIG. 1 to the printing position shown in FIG. 3, the print controller 202 lowers the cap unit 10 down to the evacuate position shown in FIG. 3 by using the maintenance control unit 210. Due to this, the ejection port surface 8*a* of the print head 8 separates from a cap member 10*a*. After this, the print controller 202 rotates the print head 8 by 45 degrees while adjusting the height in the vertical direction of the print head 8 by using the head carriage control unit 208 and causes the ejection port surface 8*a* to face the platen 9. In a case where the printing operation is completed and the print head 8 moves from the printing position to the standby position, the process opposite to that described above is performed by the print controller 202.

Figure 4:
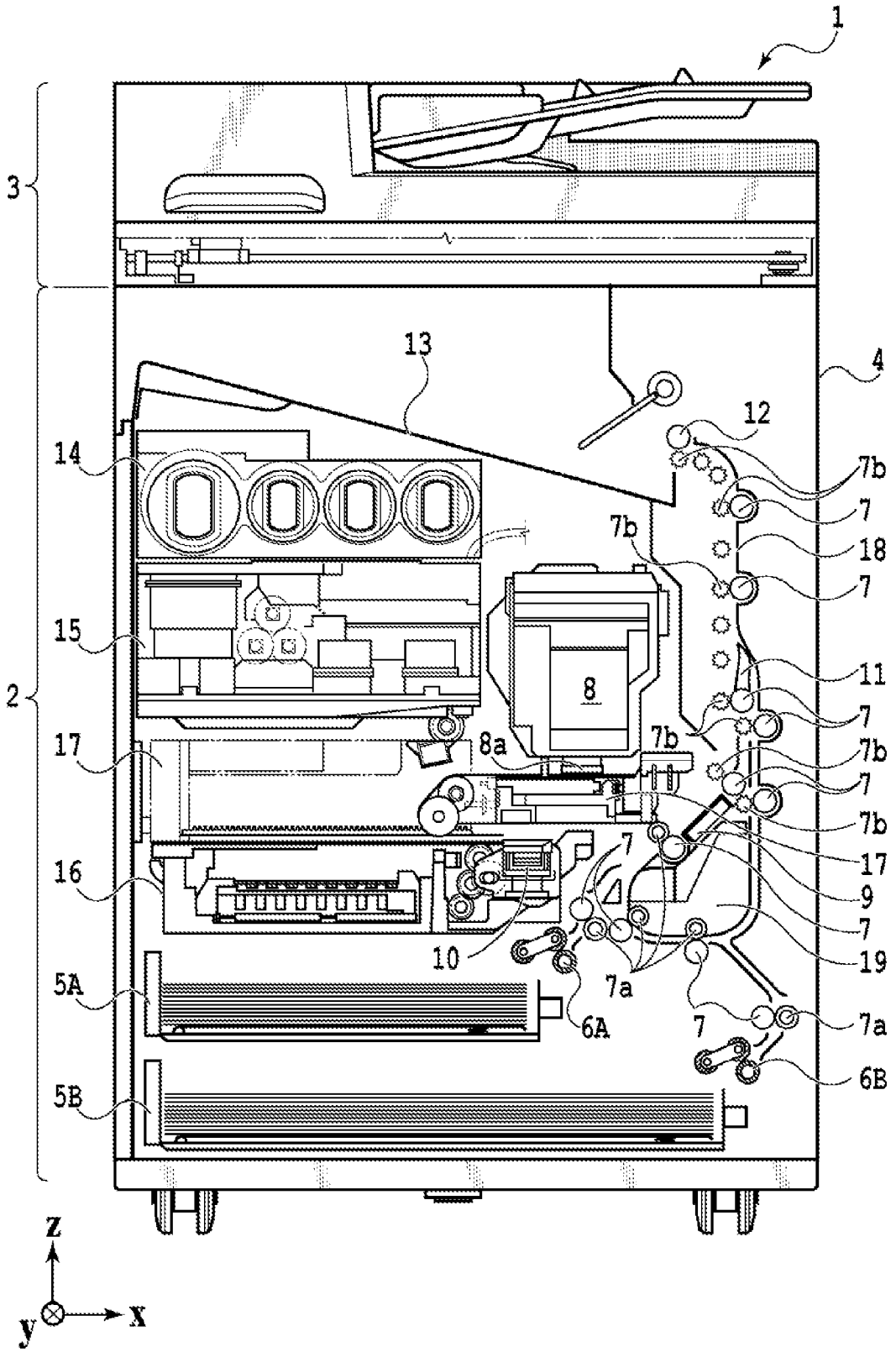
FIG. 4 is a diagram in a case where the printing apparatus is in a maintenance state.

FIG. 4 is a diagram in a case where the printing apparatus 1 is in a maintenance state. At the time of moving the print head 8 from the standby position shown in FIG. 1 to a maintenance position shown in FIG. 4, the print controller 202 moves the cap unit 10 in the vertically downward direction as well as moving the print head 8 in the vertically upward direction. Then, the print controller 202 moves the wiping unit 17 from the evacuate position in the rightward direction in FIG. 4. After this, the print controller 202 moves the print head 8 to the maintenance position at which the maintenance operation is possible by moving the print head 8 in the vertically downward direction.

On the other hand, in a case of moving the print head 8 from the printing position shown in FIG. 3 to the maintenance position shown in FIG. 4, the print controller 202 moves the print head 8 in the vertically upward direction while rotating the print head 8 by 45 degrees. Then, the print controller 202 moves the wiping unit 17 from the evacuate position in the rightward direction. After this, the print controller 202 moves the print head 8 to the maintenance position at which the maintenance operation by the maintenance unit 16 is possible by moving the print head 8 in the vertically downward direction.

<Ink Supply Unit (Ink Circulation System)>

Figure 5:
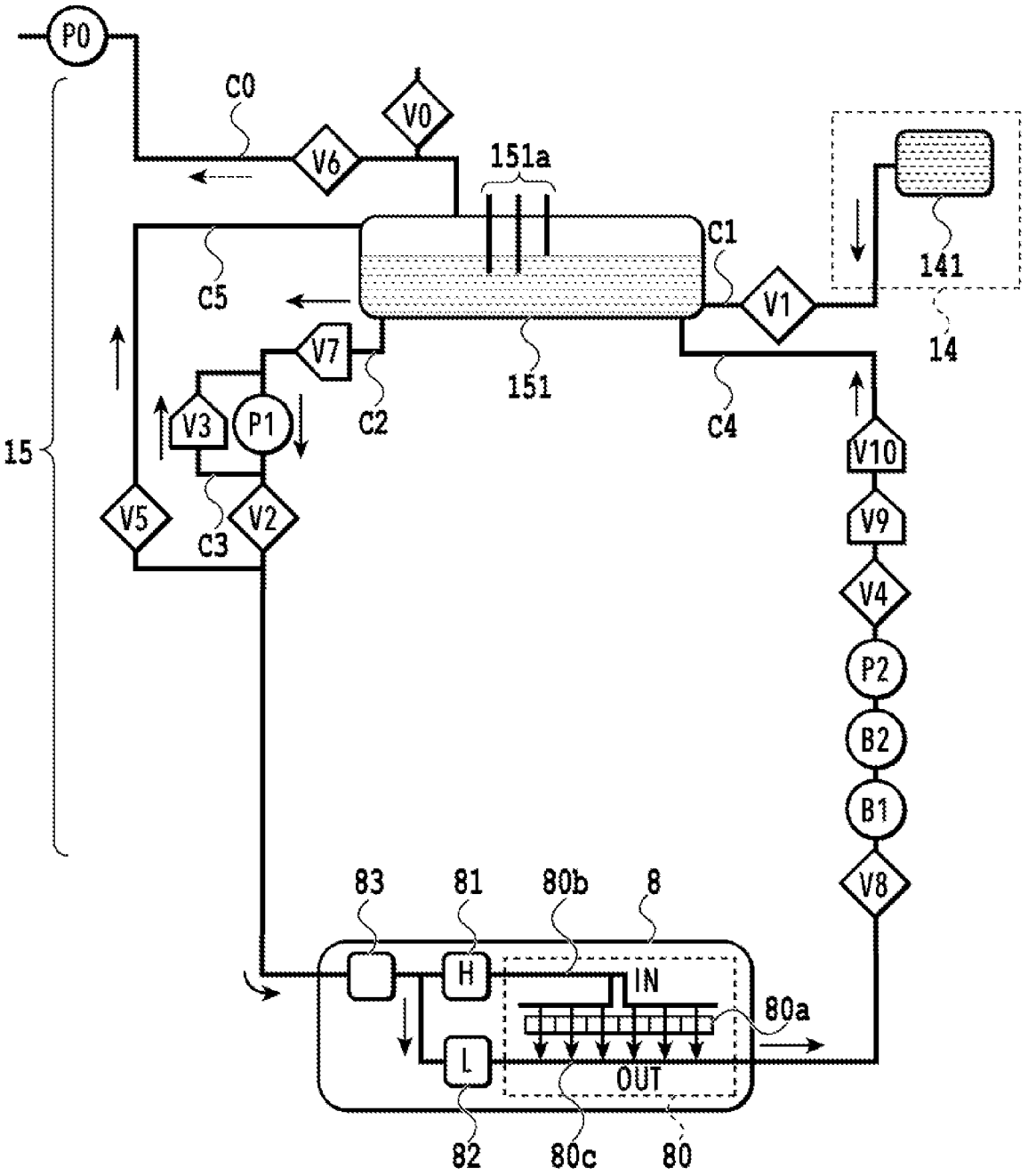
FIG. 5 is a diagram explaining a flow path configuration of an ink circulation system.

FIG. 5 is a diagram including the ink supply unit 15 adopted in the ink jet printing apparatus 1 of the present embodiment. By using FIG. 5, the flow path configuration of the ink circulation system of the present embodiment is explained. The ink supply unit 15 supplies ink supplied from the ink tank unit 14 to the print head 8 (head unit). In FIG. 5, the configuration of one color ink is shown, but actually, such a configuration is prepared for each ink color (for example, for each of cyan (C), magenta (M), yellow (Y), black (Bk)). The ink supply unit 15 is controlled basically by the ink supply control unit 209 shown in FIG. 2. In the following, each configuration of the ink supply unit 15 is explained.

Ink circulates mainly between a sub tank 151 and the print head 8. In the print head 8, the ejection operation of ink is performed based on image data and the ink that is not ejected is recovered again to the sub tank 151.

The sub tank 151 that stores a predetermined amount of ink is connected to a supply flow path C2 for supplying ink to the print head 8 and a recovery flow path C4 for recovering ink from the print head 8. That is, the circulation path through which ink circulates is configured by the sub tank 151, the supply flow path C2, the print head 8, and the recovery flow path C4. Further, the sub tank 151 is connected to an air flow path C0 through which air flows.

In the sub tank 151, a liquid surface detection unit 151*a* including a plurality of pins is provided and it is possible for the ink supply control unit 209 to grasp the height of the ink liquid surface, that is, the ink remaining amount within the sub tank 151 by detecting whether or not there is a conduction current between the plurality of pins. A decompression pump P0 (within-tank decompression pump) is a negative pressure generation source for decompressing the inside of the sub tank 151. An atmosphere open valve V0 is a valve for switching whether or not to cause the inside of the sub tank 151 to communicate with the atmosphere.

A main tank 141 is a tank that stores ink to be supplied to the sub tank 151. The main tank 141 has a configuration attachable to and detachable from the printing apparatus main body. On the way of a tank connection flow path C1 that connects the sub tank 151 and the main tank 141, a tank supply valve V1 for switching connections of the sub tank 151 and the main tank 141 is arranged.

In a case of detecting that the ink within the sub tank 151 becomes smaller than a predetermined amount by the liquid surface detection unit 151*a*, the ink supply control unit 209 closes the atmosphere open valve V0, a supply valve V2, a recovery valve V4, and a head exchange valve V5, and opens the tank supply valve V1 and a sub tank decompression valve V6. In this state, the ink supply control unit 209 causes the decompression pump P0 to operate. Then, the pressure inside the sub tank 151 becomes negative and ink is supplied from the main tank 141 to the sub tank 151. In a case of detecting that the ink within the sub tank 151 exceeds a predetermined amount by the liquid surface detection unit 151*a*, the ink supply control unit 209 closes the tank supply valve V1 and the sub tank decompression valve V6 and suspends the decompression pump P0.

The supply flow path C2 is a flow path for supplying ink from the sub tank 151 to the print head 8 and on the way thereof, a supply pump P1 and the supply valve V2 are arranged. During the printing operation, by driving the supply pump P1 in the state where the supply valve V2 is open, it is possible to circulate ink in the circulation path while supplying ink to the print head 8. The amount of ink ejected per unit time by the print head 8 fluctuates in accordance with image data. The amount of flow of the supply pump P1 is determined so as to be compatible also with a case where the print head 8 performs the ejection operation that maximizes the amount of ink to be consumed per unit time. Further, in the supply flow path C2, a check valve V7 that prevents a backflow of ink to the sub tank 151 is arranged. The check valve V7 is a valve that permits a flow of ink in one direction.

A relief flow path C3 is a flow path that is located on the upstream side of the supply valve V2 and which connects the upstream side and the downstream side of the supply pump P1. On the way of the relief flow path C3, a relief valve V3, which is a differential pressure valve, is arranged. The relief valve is not opened and closed by a drive mechanism, but is biased by a spring and configured so as to open in a case where a predetermined pressure is reached. For example, in a case where the ink supply amount per unit time from the supply pump P1 is larger than the total value of the ejection amount per unit time of the print head 8 and the flow amount (amount of ink to be drawn) per unit time of the recovery pump P2, the relief valve V3 is opened in accordance with the pressure that is exerted on the relief valve V3 itself. Due to this, a circulation path configured by a part of the supply flow path C2 and the relief flow path C3 is formed. By providing the configuration of the relief flow path C3, the ink supply amount for the print head 8 is adjusted in accordance with the ink consumption in the print head 8, and therefore, it is possible to stabilize the pressure within the circulation path irrespective of image data.

The recovery flow path C4 is a flow path for recovering ink from the print head 8 to the sub tank 151 and on the way thereof, a recovery pump P2, the recovery valve V4, a suction valve V8, and check valves V9 and V10 are arranged. In the recovery flow path C4, buffer chambers B1 and B2 are further arranged. At the time of circulating ink within the circulation path, the recovery pump P2 functions as a negative pressure generation source to suck ink from the print head 8. By the drive of the recovery pump P2, an appropriate pressure difference arises between an IN flow path 80*b* and an OUT flow path 80*c* within the print head 8, and therefore, it is possible to circulate ink between the IN flow path 80*b* and the OUT flow path 80*c*. The flow path configuration within the print head 8 will be described later in detail.

The check valve V9 and the check valve V10 are each a valve that prevents a backflow of ink to the print head 8. In the present embodiment, two check valves are provided preliminarily. The recovery valve V4 is also a valve for preventing a backflow in a case where the printing operation is not being performed, that is, ink is not being circulated within the circulation path. In the circulation path of the present embodiment, the sub tank 151 is arranged above the print head 8 in the vertical direction (see FIG. 1). Because of this, in a case where the supply pump P1 and the recovery pump P2 are not driven, there is a possibility that ink flows backward to the print head 8 from the sub tank 151 due to a water head difference between the sub tank 151 and the print head 8. In order to prevent such a backflow, in the present embodiment, the check valve V9, the check valve V10, and the recovery valve V4 are provided in the recovery flow path C4.

The supply valve V2 also functions as a valve for preventing supply of ink to the print head 8 from the sub tank 151 in a case where the printing operation is not being performed, that is, ink is not being circulated within the circulation path.

The suction valve V8 is controlled by the ink supply control unit 209 so as to close at the time of the suction operation being performed by capping the print head 8 by the cap unit 10 (not shown schematically in FIG. 5). The reason is to prevent the ink within the flow path from being sucked into the cap unit 10 more than necessary at the time of suction. At the time of suction, the supply valve V2 and the head exchange valve V5 are also controlled by the ink supply control unit 209 so as to close.

The buffer chambers B1 and B2 are parts for reducing the influence of expansion and contraction of air bubbles in the ink within the flow path. The buffer chambers B1 and B2 include a compression spring and a flexible member, such as a film, and the film expands and contracts as the compression spring expands and contracts. In a case where the air bubbles in the ink within the flow path expand and contract due to a change in temperature or the like in the state where ink is not circulating, the buffer chambers B1 and B2 expand and contract following a change in volume of the air bubbles in the flow path. Due to this, it is possible to prevent ink leakage at the ejection port and drawing of air from the ejection port, which result from a change in the pressure exerted on the ejection port by the air bubbles expanding and contracting. In the present embodiment, the two buffer chambers B1 and B2 are provided for expansion and contraction, respectively.

A head exchange flow path C5 is a flow path that connects the supply flow path C2 and an air chamber (space in which ink is not stored) of the sub tank 151 and on the way thereof, the head exchange valve V5 is arranged. One end of the head exchange flow path C5 is connected to the upstream of the print head 8 in the supply flow path C2 and connected to the downstream side of the supply valve V2. The other end of the head exchange flow path C5 connects to the upper portion of the sub tank 151 in the direction of gravity and communicates with the air chamber inside the sub tank 151. The head exchange flow path C5 is made use of in a case where ink is drawn from the print head 8 in use at the time of exchanging the print head 8 or transporting the printing apparatus 1. The head exchange valve V5 is controlled by the ink supply control unit 209 so as to close except for a case where the print head 8 is filled with ink and a case where ink is drawn from the print head 8.

Next, the flow path configuration within the print head 8 is explained. The ink supplied to the print head 8 by the supply flow path C2 is supplied to a first negative pressure control unit 81 and a second negative pressure control unit 82 after passing through a filter 83. The control pressure of the first negative pressure control unit 81 is set to a weak negative pressure (negative pressure whose difference in pressure from the atmospheric pressure is small). The control pressure of the second negative pressure control unit 82 is set to a strong negative pressure (negative pressure whose difference in pressure from the atmospheric pressure is large). The pressures in the first negative pressure control unit 81 and the second negative pressure control unit 82 are generated in an appropriate range by the drive of the recovery pump P2.

In an ink ejection unit 80, a plurality of printing element substrates 80*a* on which a plurality of ejection ports is arrayed is arranged and a long ejection port row is formed. The common supply flow path 80*b* (IN flow path) for guiding ink supplied by the first negative pressure control unit 81 and the common recovery flow path 80*c* (OUT flow path) for guiding ink supplied by the second negative pressure control unit 82 are also extending in the array direction of the printing element substrate 80*a*. Further, on the individual printing element substrate 80*a*, an individual supply flow path connected with the common supply flow path 80*b* and an individual recovery flow path connected with the common recovery flow path 80*c* are formed. Because of this, on the individual printing element substrate 80*a*, a flow of ink is generated, which flows in from the common supply flow path 80*b* where the negative pressure is relatively weak and flows out to the common recovery flow path 80*c* where the negative pressure is relatively strong. In the path between the individual supply flow path and the individual recovery flow path, a pressure chamber that communicates with each ejection port and which is filled with ink is provided and also in the ejection port or the pressure chamber not performing printing, a flow of ink is generated. In a case where the ejection operation is performed on the printing element substrate 80*a*, a part of the ink that moves from the common supply flow path 80*b* to the common recovery flow path 80*c* is consumed by being ejected from the ejection port, but the ink that is not ejected moves to the recovery flow path C4 via the common recovery flow path 80*c*.

Figure 6A:
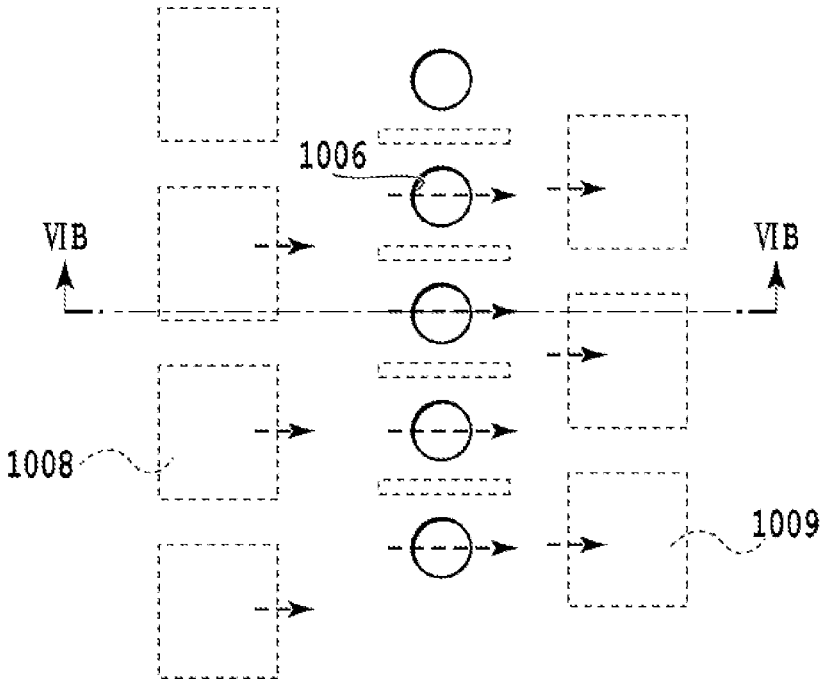
FIG. 6A and FIG. 6B are diagrams explaining an ejection port and a pressure chamber.
Figure 6B:
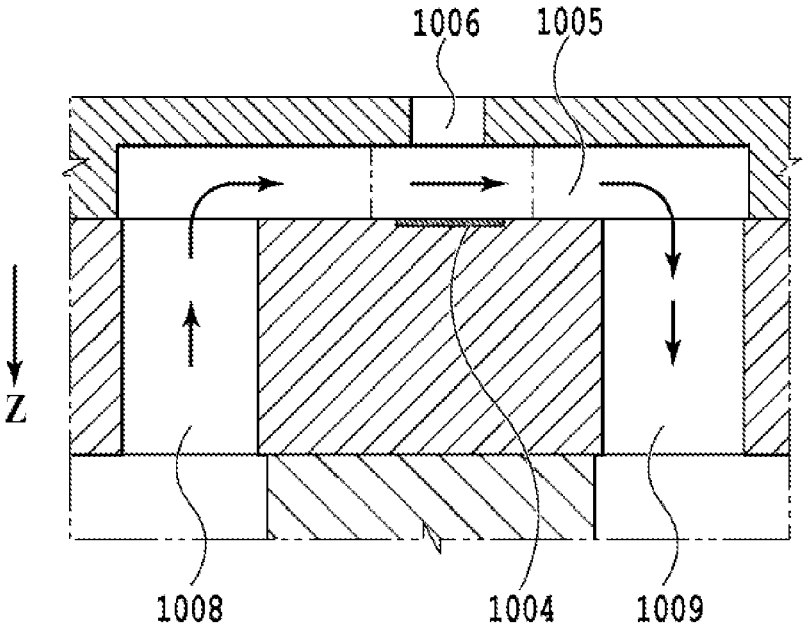

FIG. 6A is a schematic plan diagram showing an enlarged part of the printing element substrate 80*a* and FIG. 6B is a schematic sectional diagram along a section line VIB-VIB in FIG. 6A. The printing element substrate 80*a* is provided with a pressure chamber 1005 filled with ink and an ejection port 1006 through which ink is ejected. In the pressure chamber 1005, at a position in opposition to the ejection port 1006, a printing element 1004 is provided. Further, on the printing element substrate 80*a*, an individual supply flow path 1008 that connects with the common supply flow path 80*b* and an individual recovery flow path 1009 that connects with the common recovery flow path 80*c* are formed in plurality for each ejection port 1006.

By the configuration described above, on the printing element substrate 80*a*, a flow of ink is generated, which flows in from the common supply flow path 80*b* where the negative pressure is relatively weak (absolute value of pressure is high) and flows out to the common recovery flow path 80*c* where the negative pressure is relatively strong (absolute value of pressure is low). In more detail, ink flows in the order of the common supply flow path 80*b*→the individual supply flow path 1008→the pressure chamber 1005→the individual recovery flow path 1009→the common recovery flow path 80*c*. In a case where ink is ejected by the printing element 1004, a part of the ink that moves from the common supply flow path 80*b* to the common recovery flow path 80*c* is discharged to the outside of the print head 8 by being ejected from the ejection port 1006. On the other hand, the ink that is not ejected from the ejection port 1006 is recovered to the recovery flow path C4 via the common recovery flow path 80*c*.

In a case where the printing operation is performed, the ink supply control unit 209 closes the tank supply valve V1, the head exchange valve V5, and the sub tank decompression valve V6, opens the atmosphere open valve V0, the supply valve V2, the recovery valve V4, and the suction valve V8, and drives the supply pump P1 and the recovery pump P2. Due to this, a circulation path of the sub tank 151→the supply flow path C2,→the print head 8→the recovery flow path C4→the sub tank 151 is established. In a case where the ink supply amount per unit time from the supply pump P1 is larger than the total value of the ejection amount per unit time of the print head 8 and the flow amount per unit time in the recovery pump P2, ink flows into the relief flow path C3 from the supply flow path C2. Due to this, the flow amount of ink that flows into the print head 8 from the supply flow path C2 is adjusted.

In a case where the printing operation is not being performed, the ink supply control unit 209 suspends the supply pump P1 and the recovery pump P2 and closes the atmosphere open valve V0, the supply valve V2, the recovery valve V4, and the suction valve V8. Due to this, the flow of ink within the print head 8 suspends and a backflow due to the water head difference between the sub tank 151 and the print head 8 is also suppressed. Further, by closing the atmosphere open valve V0, leakage of ink and evaporation of ink from the sub tank 151 are suppressed.

In a case where ink is drawn from the print head 8, the ink supply control unit 209 closes the atmosphere open valve V0, the tank supply valve V1, the supply valve V2, the recovery valve V4, and the suction valve V8, opens the head exchange valve V5, and drives the decompression pump P0. Due to this, the inside of the sub tank 151 enters a negative pressure state and the ink within the print head 8 is recovered to the sub tank 151 via the head exchange flow path C5. As described above, the head exchange valve V5 is a valve that is closed at the time of the normal printing operation and the standby and opened at the time of drawing ink from the print head 8. The head exchange valve V5 is also opened at the time of filling the head exchange flow path C5 with ink in a case where the print head 8 is filled with ink.

<Ink Supply Unit>

Figure 7A:
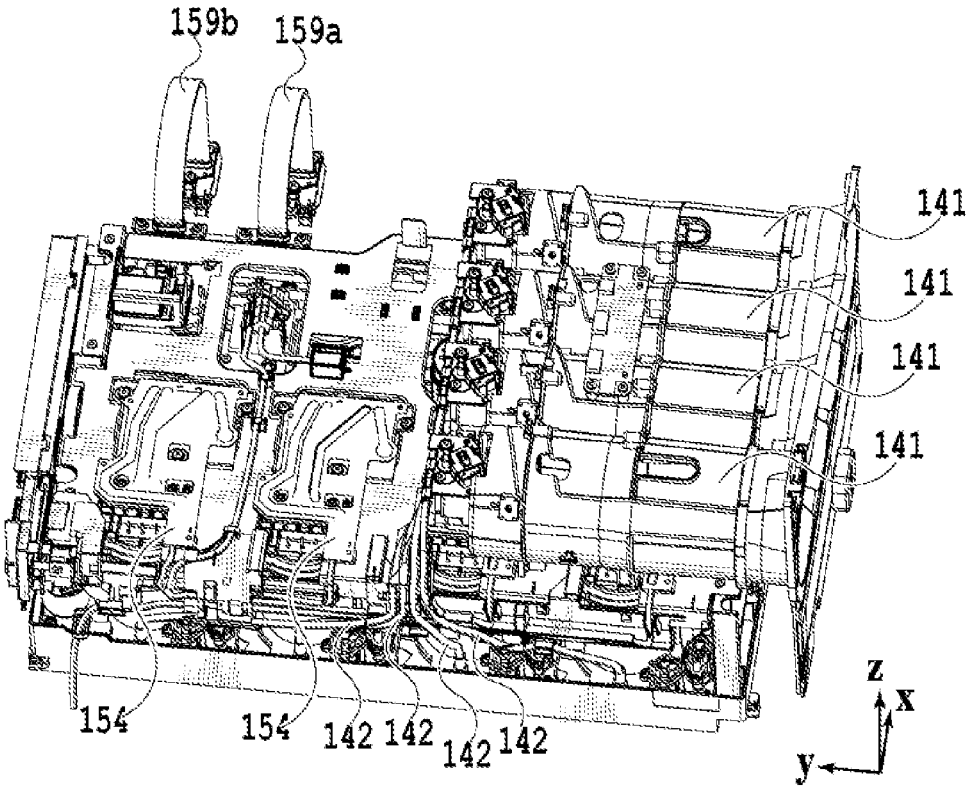
FIG. 7A and FIG. 7B are each a perspective diagram of an ink tank unit and an ink supply unit.
Figure 7B:
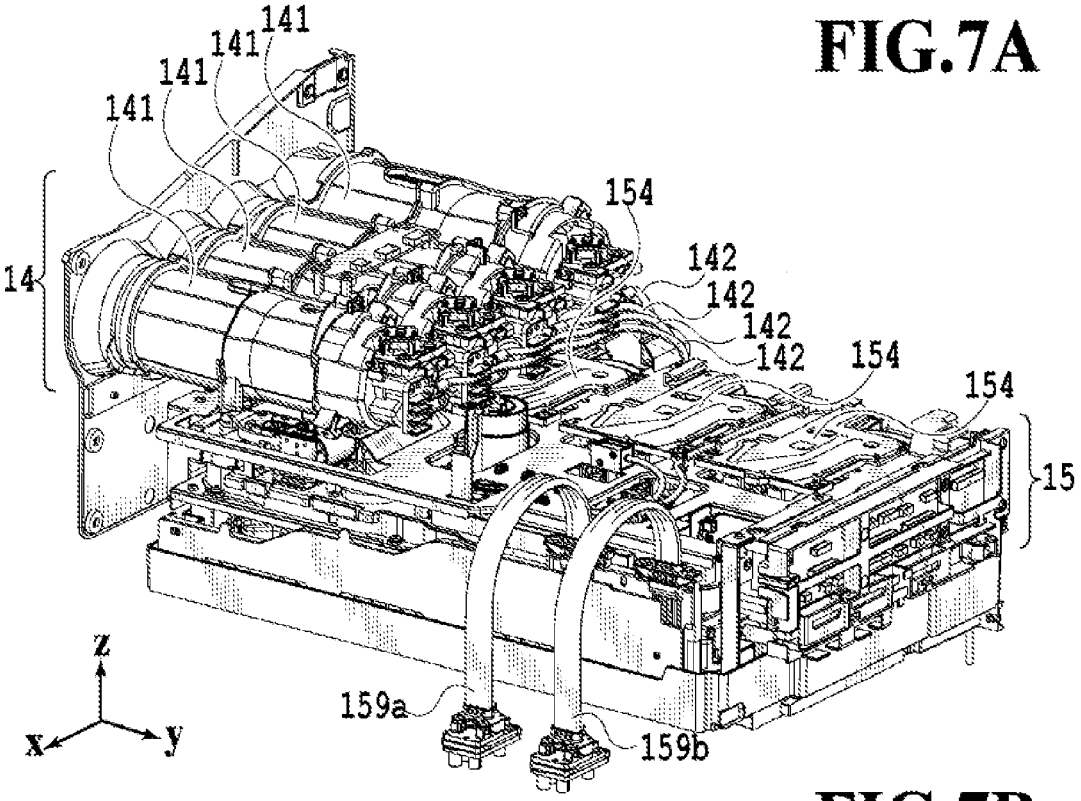

FIG. 7A and FIG. 7B are perspective diagrams including the ink tank unit 14 and the ink supply unit 15. From the main tank 141 of each color of the ink tank unit 14, ink is supplied to the ink supply unit 15 via a supply tube 142. That is, within the supply tube 142, the tank connection flow path C1 that supplies ink from the main tank 141 to the sub tank 151 is formed. As shown in FIG. 7B, the ink supply unit 15 is arranged under the ink tank unit 14 in the direction of gravity. Hereinafter, in a case where "above" and "under" are simply referred to, it is assumed that "above" and "under" in the direction of gravity (z-direction) are meant. The arrangement configuration of the ink supply unit 15 will be described later. In the ink supply unit 15, a linking tube 159 is provided for each of the supply flow path C2 and the recovery flow path C4. The inside of the linking tube 159 is divided into flow paths corresponding to each color ink. That is, within a linking tube 159*a* on one hand, the supply flow paths C2 corresponding to each color are formed and within a linking tube 159*b* on the other hand, the recovery flow paths C4 corresponding to each color are formed. The linking tubes 159*a* and 159*b* are connected to the print head 8 (not shown schematically in FIG. 7A and FIG. 7B). At the upper portion of the ink supply unit 15, an atmosphere communication plate 154 is arranged.

Figure 8A:
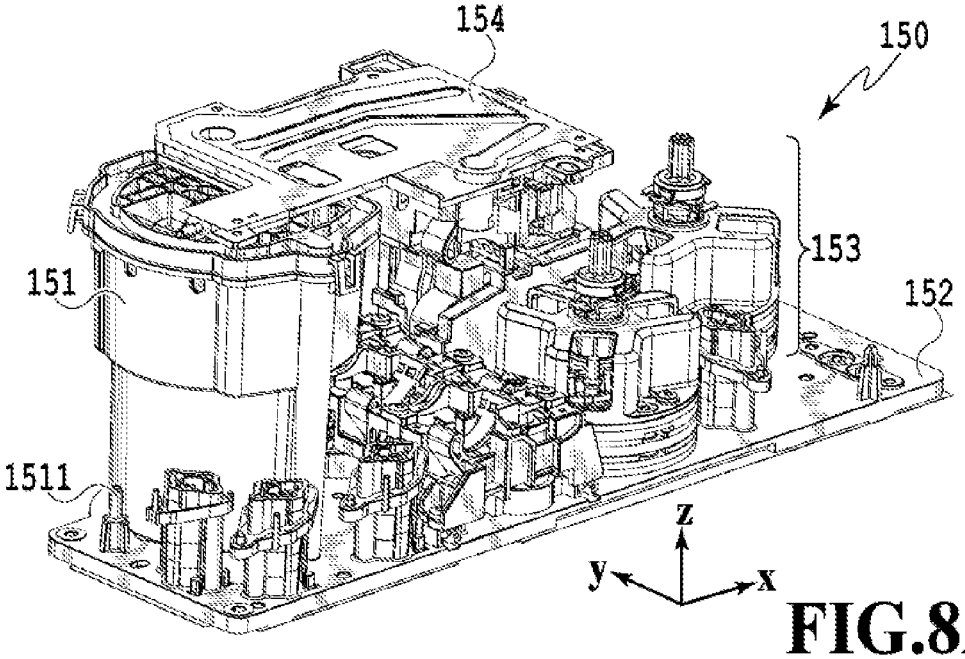
FIG. 8A and FIG. 8B are each a perspective diagram of a sub unit.
Figure 8B:
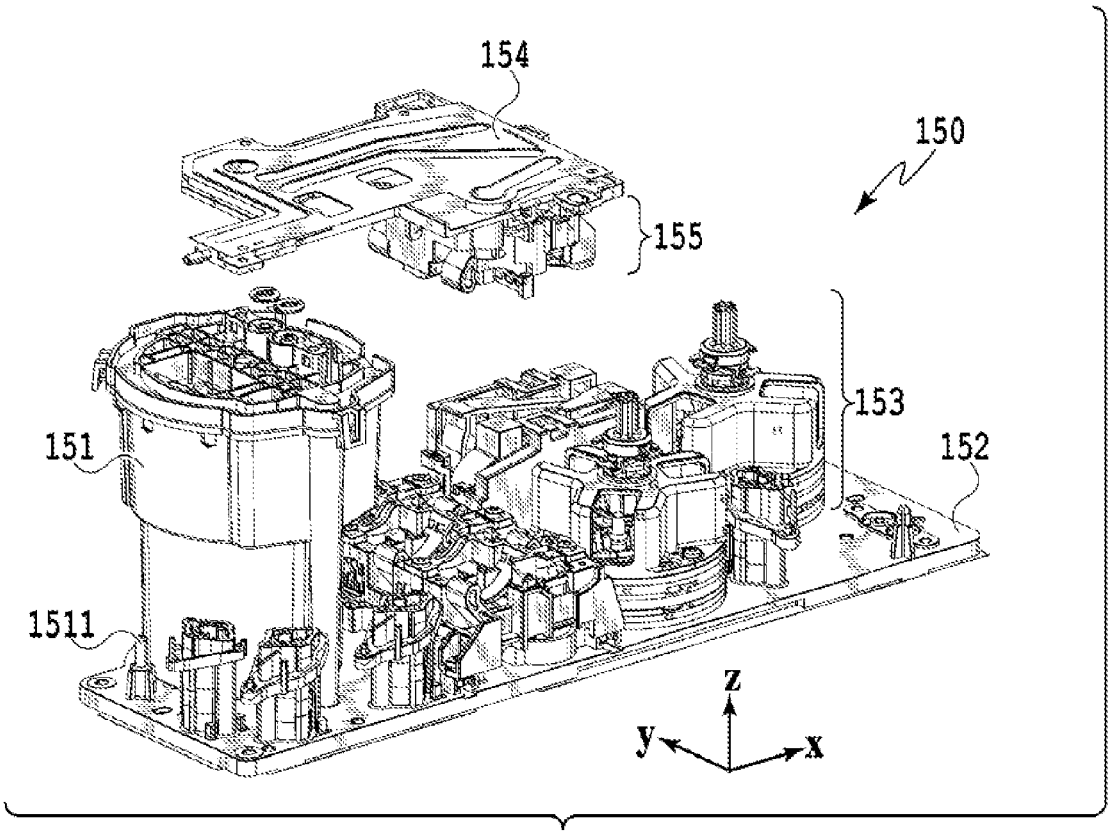

FIG. 8A is a perspective diagram of a sub unit 150 configuring the ink supply unit 15. FIG. 8B is a perspective diagram in a state where the atmosphere communication plate 154 in FIG. 8A is separated from the sub unit 150. The sub unit 150 is provided for each ink color. Here, the sub unit 150 corresponding to an arbitrary ink color is shown. The sub unit 150 includes the sub tank 151, an ink flow path plate 152 arranged under the sub tank 151, and the atmosphere communication plate 154 arranged above the sub tank 151. On the ink flow path plate 152, a tube connection portion 1511 that connects the supply tube 142 (see FIG. 7A and FIG. 7B) connected to the main tank 141 is arranged. Ink is supplied to the sub tank 151 through the tank connection flow path C1 formed within the ink flow path plate 152. Further, within the ink flow path plate 152, the supply flow path C2 through which ink is supplied from the sub tank 151 to the print head 8 and the recovery flow path C4 through which ink is recovered to the sub tank 151 from the print head 8 are formed. Within the atmosphere communication plate 154, the air flow path C0 through which air flows is formed.

As shown in FIG. 8A and FIG. 8B, in the present embodiment, above the ink flow path plate 152, the sub tank 151 and one or a plurality of function parts (referred to as a first function part group 153) are arranged. The first function part group 153 is a general term of function parts that act on the ink flow path. The function parts included in the first function part group 153 are, for example, the drive valve for opening and closing the flow path by a drive mechanism, the differential pressure valve, the check valve, the circulation pump used for circulation (supply pump P1, recovery pump P2), and the buffer chambers B1 and B2. The drive valve included in the first function part group 153 is, for example, the tank supply valve V1, the supply valve V2, the recovery valve V4, the head exchange valve V5, and the suction valve V8. The differential pressure valve included in the first function part group 153 is, for example, the relief valve V3. The check valve is one kind of differential pressure valve and the check valve V7, the check valve V9, and the check valve V10 are also included in the differential pressure valve. As described above, the first function part group 153 includes the function parts that act on the tank connection flow path C1, the supply flow path C2, the relief flow path C3, the recovery flow path C4, or the head exchange flow path C5. The connection portion of the supply flow path C2 and the relief flow path C3 and the connection portion of the supply flow path C2 and the head exchange flow path C5 are provided within the ink flow path plate 152 (not shown schematically).

Under the atmosphere communication plate 154, one or a plurality of function parts (referred to as a second function part group 155) is arranged. The second function part group 155 is a general term of function parts that act on the air flow path. The function parts included in the second function part group 155 are, for example, the drive valve for opening and closing the flow path by a drive mechanism. The drive valve is, for example, the atmosphere open valve V0 and the sub tank decompression valve V6. As described above, the second function part group 155 includes the function parts that act on the air flow path C0.

The sub tank 151, the ink flow path plate 152, the atmosphere communication plate 154, the first function part group 153, and the second function part group 155 shown in FIG. 8A and FIG. 8B are provided for each ink color. In the present embodiment, it is possible to make the configuration of each of the main tank 141, the sub tank 151, the ink flow path plate 152, the atmosphere communication plate 154, the first function part group 153, and the second function part group 155 common to all the ink colors. By making the configuration of the sub unit 150 common to all the ink colors, it is possible to reduce the cost of the sub unit 150 compared to a case where the configuration of the sub unit 150 is prepared for each ink color. The function parts included in the first function part group 153 and the second function part group 155 are merely exemplary and it may also be possible to exclude part of the function parts or to include another function part other than those described above.

Figure 9A:
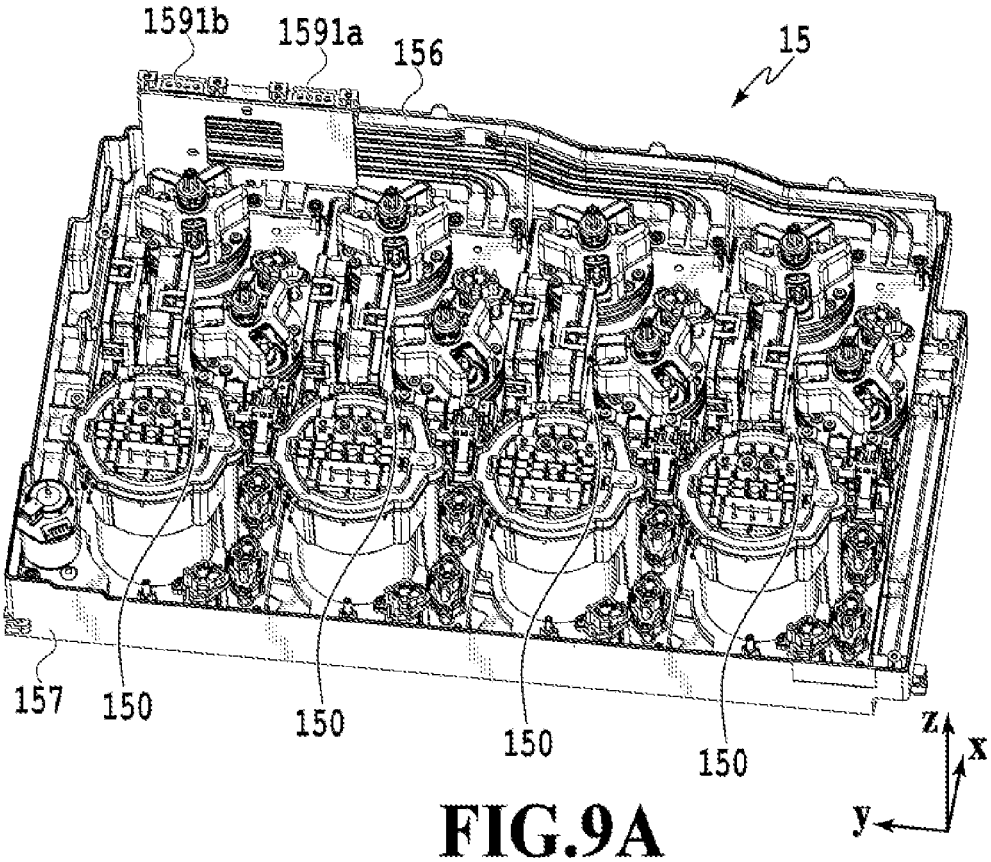
FIG. 9A and FIG. 9B are diagrams explaining the ink supply unit.

FIG. 9A is a perspective diagram of the ink supply unit 15. The ink supply unit 15 includes a longitudinally-installed flow path concentration plate 156 for concentrating the flow paths for each sub unit 150, in addition to the sub unit 150 for each ink color. In this example, the flow path concentration plate 156 and the four sub units 150 are arranged so as to be included within the xy-plane demarcated by a supply pan 157. Further, a plurality of the sub units 150 having the same arrangement configuration is arranged side by side in the y-direction, facing in the same direction.

Figure 9B:
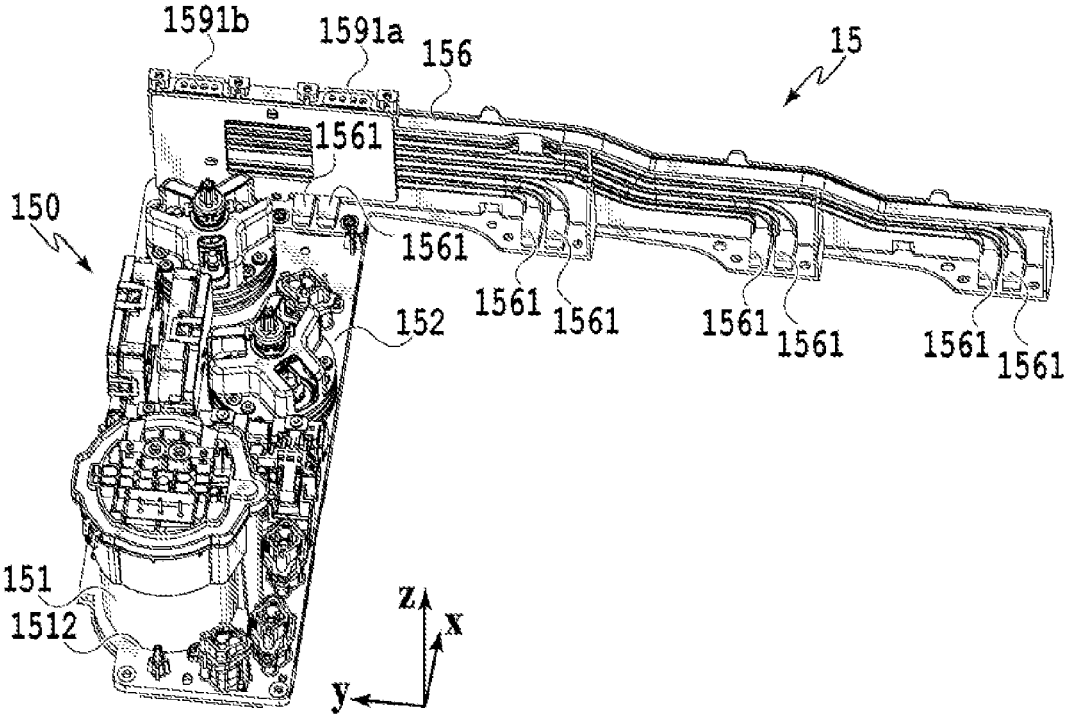

FIG. 9B is a perspective diagram of a part of the ink supply unit 15 (specifically, only the sub unit 150 corresponding to one color and the flow path concentration plate 156 are shown). The sub tank 151 is arranged approximately above one end portion of the ink flow path plate 152. That is, a connection portion (hereinafter, referred to as a first connection portion 1512, see FIG. 11C also) of the sub tank 151 and the ink flow path plate 152 is provided on the undersurface of the sub tank 151. Within the ink flow path plate 152, the flow paths (supply flow path C2 and recovery flow path C4) are formed so as to extend in the horizontal direction (in detail, x-direction) from the first connection portion 1512 that connects with the sub tank 151. The flow path extends in the x-direction as a whole and may be guided in another direction on the way. On the other end portion on the opposite side in the x-direction of the end portion on which the first connection portion 1512 of the ink flow path plate 152 is provided, a connection portion (hereinafter, referred to as a second connection portion 1561) that connects the flow path within the ink flow path plate 152 to the flow path within the flow path concentration plate 156 is provided.

The flow path concentration plate 156 is arranged above the ink flow path plate 152 of each sub unit 150 so as to traverse each second connection portion 1561. Within the flow path concentration plate 156, a flow path that guides ink to be sent to each second connection portion 1561 or ink to be sent from each second connection portion 1561 approximately in the y-direction (approximately parallel to the direction in which the ink flow path plates 152 are arranged side by side) is formed (see FIG. 14A also). As shown in FIG. 9B, within the flow path concentration plate 156, the flow paths of all the ink colors are arranged one on top of another in the z-direction. The flow path concentration plate 156 includes a third connection portion 1591 that connects with the linking tube 159 (see FIG. 7A and FIG. 7B).

As described above, the supply flow path C2 and the recovery flow path C4 are formed inside the ink flow path plate 152 for each ink color, the flow path concentration plate 156 used in common for all the ink colors, and the linking tube 159.

Figure 10:
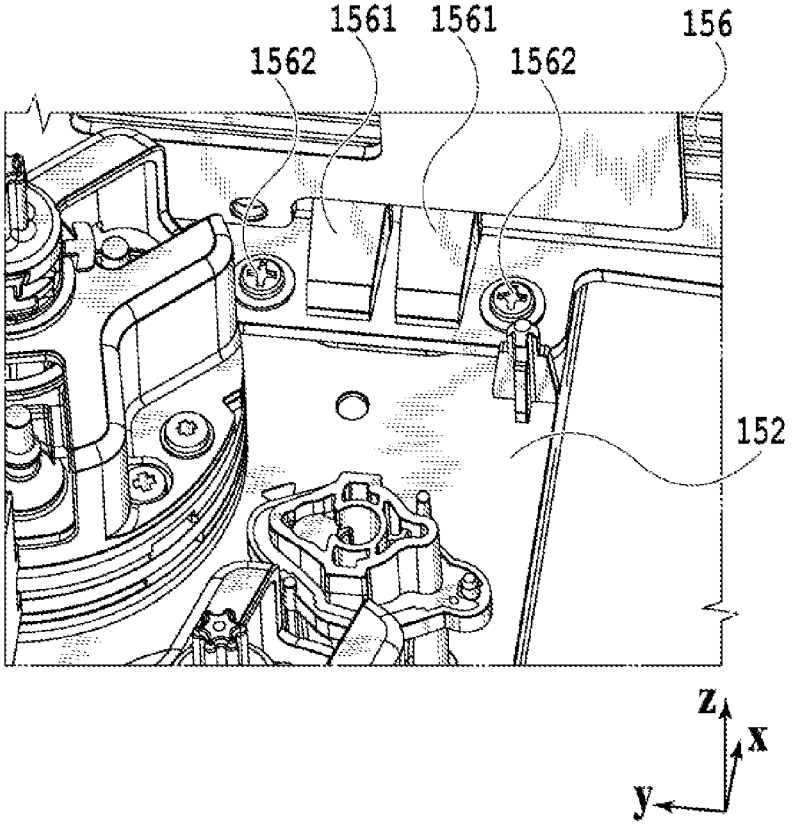
FIG. 10 is an enlarged diagram of a connection portion between an ink flow path plate and a flow path concentration plate.

FIG. 10 is an enlarged diagram of the connection portion of the ink flow path plate 152 and the flow path concentration plate 156 in FIG. 9B. The two plates perpendicular to each other, that is, the ink flow path plate 152 extending in the xy-direction (horizontal direction) and the flow path concentration plate 156 extending in the yz-direction (direction of plane including the direction of gravity) are screwed by screws 1562. The reason the flow path concentration plate 156 is provided in the present embodiment is as follows. At the time of providing a flow path relating to ink for guiding ink between the sub tank 151 and the print head 8, in a case where the entire section is provided for each ink color, the cost is raised. Because of this, in the present embodiment, the linking tube 159 that concentrates the flow paths for each ink color is adopted. However, in order to make use of the linking tube 159, it is necessary to put together the flow paths for each ink color. In a case where it is attempted to put together the flow paths for each ink color within the same plane as that of the ink flow path plate 152 under the sub tank 151, a plate for putting together the flow paths, which extends in the xy-direction, becomes further necessary, and therefore, the ink supply unit becomes large in the xy-direction. As a result of this, it becomes difficult to implement downsizing of the ink supply unit. Because of this, in the present embodiment, the flow path concentration plate 156 perpendicular to the ink flow path plate 152 is provided and the inside of a space demarcated by the ink flow path plate 152 and the flow path concentration plate 156 is effectively made use of while concentrating the flow paths for each ink color within the flow path concentration plate 156. Specifically, the space is made use of as a space in which the first function part group 153 is arranged. Due to this, downsizing of the ink supply unit 15 is implemented.

As described above, it is possible to make the ink supply unit 15 compact by providing the flow path concentration plate 156 perpendicular to the ink flow path plate 152 and forming the ink supply unit 15 so that the flow path of ink does not become large in the xy-direction.

<Ink Flow Path Plate>

Figure 11A:
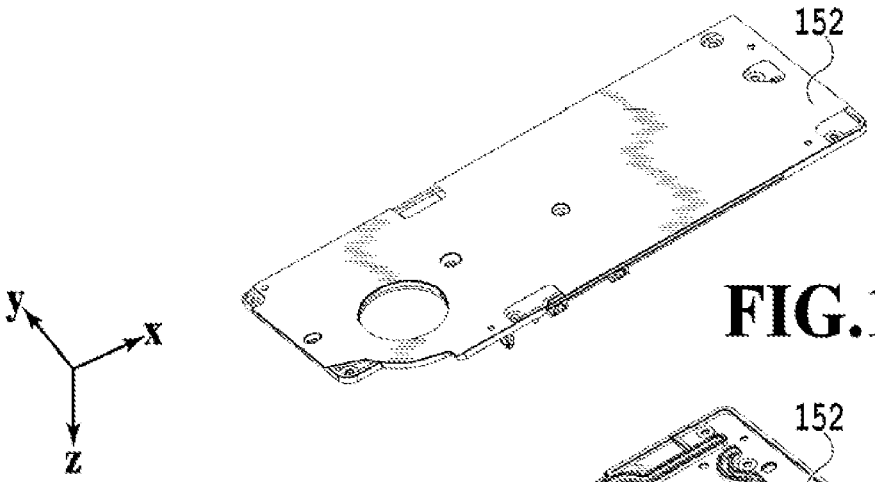
FIG. 11A to FIG. 11C are perspective diagrams explaining a configuration of the ink flow path plate.
Figure 11B:
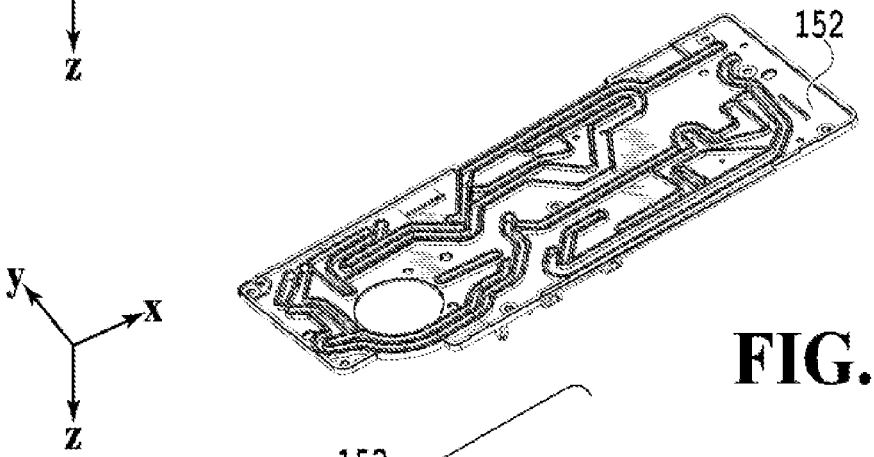
Figure 11C:
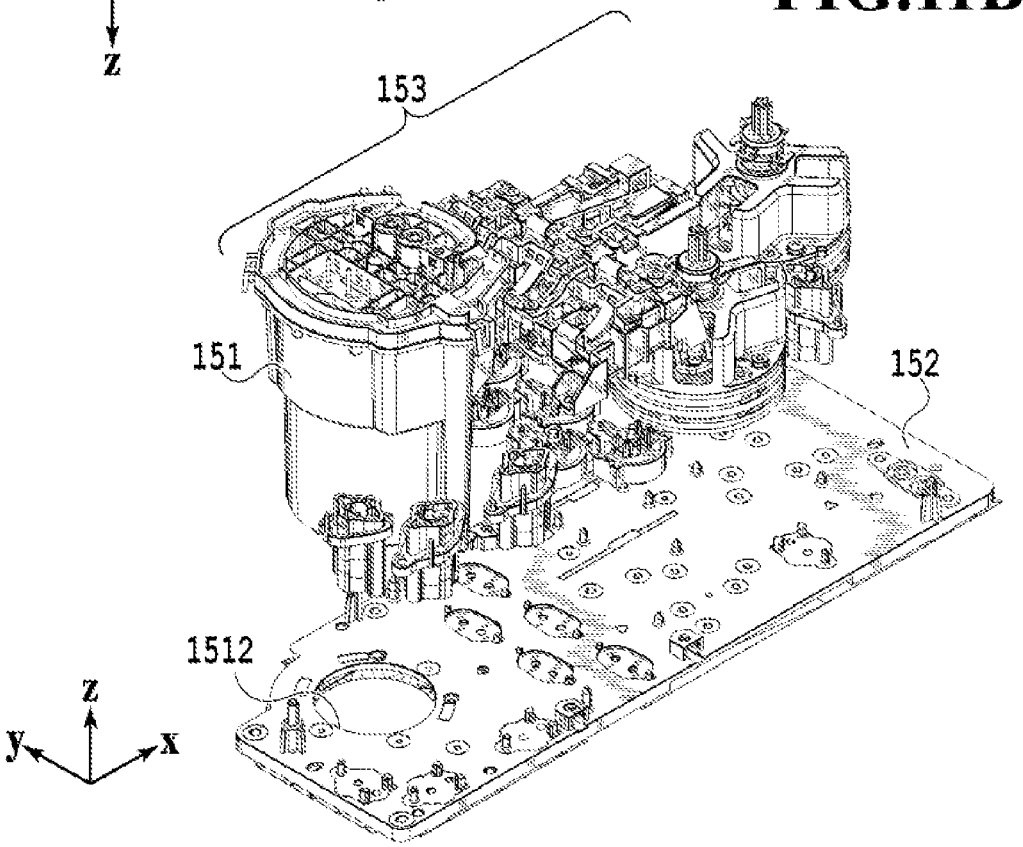

FIG. 11A to FIG. 11C are perspective diagrams explaining the configuration of the ink flow path plate 152. FIG. 11A is a diagram in a case where the ink flow path plate 152 is viewed from under. FIG. 11B is a diagram in which the film member on the surface in FIG. 11A is made transparent so that the flow paths become visible. FIG. 11C is a diagram in a case where the ink flow path plate 152 is viewed from above. FIG. 11C shows a diagram in the state where the sub tank 151 and the first function part group 153 arranged on the ink flow path plate 152 are separated.

Figure 12:
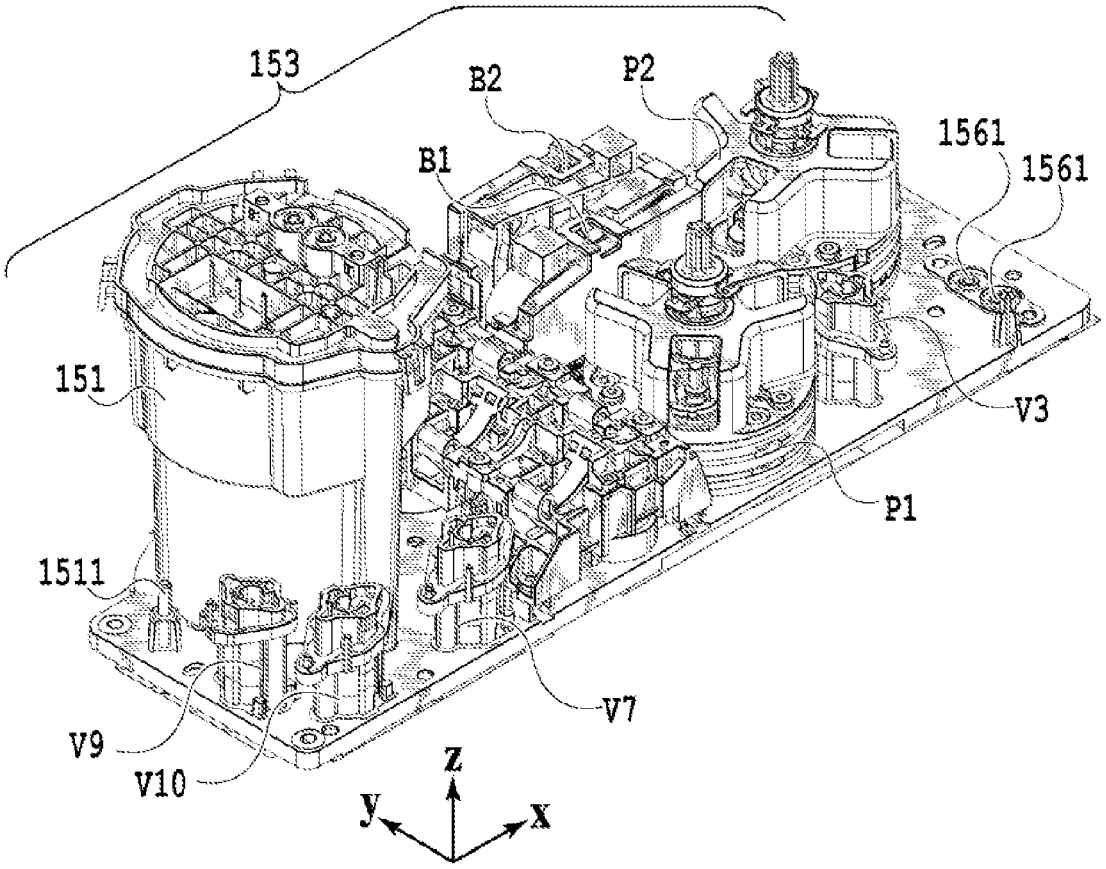
FIG. 12 is a perspective diagram explaining a configuration of the sub unit.

FIG. 12 is a perspective diagram in which the sub tank 151 and the first function part group 153 are arranged on the ink flow path plate 152. In FIG. 12, the parts corresponding to the drive valve, the differential pressure valve, the check valve, the buffer chamber, and the circulation pump shown in FIG. 5 are shown with the same symbols as those in FIG. 5. As shown in FIG. 12, the first function part group 153 is arranged above the ink flow path plate 152. The first function part group 153 is the parts that perform control of opening and closing of a flow path and control of the amount of flow of ink flowing through a flow path. Because of this, the first function part group 153 is arranged above the position corresponding to the flow path formed within the ink flow path plate 152. As described above, in the present embodiment, the first function part group 153 that acts on the flow paths relating to the flow of ink (tank connection flow path C1, supply flow path C2, relief flow path C3, recovery flow path C4, and head exchange flow path C5) is concentrated and arranged above the ink flow path plate 152.

<Flow Path Concentration Plate>

Figure 13:
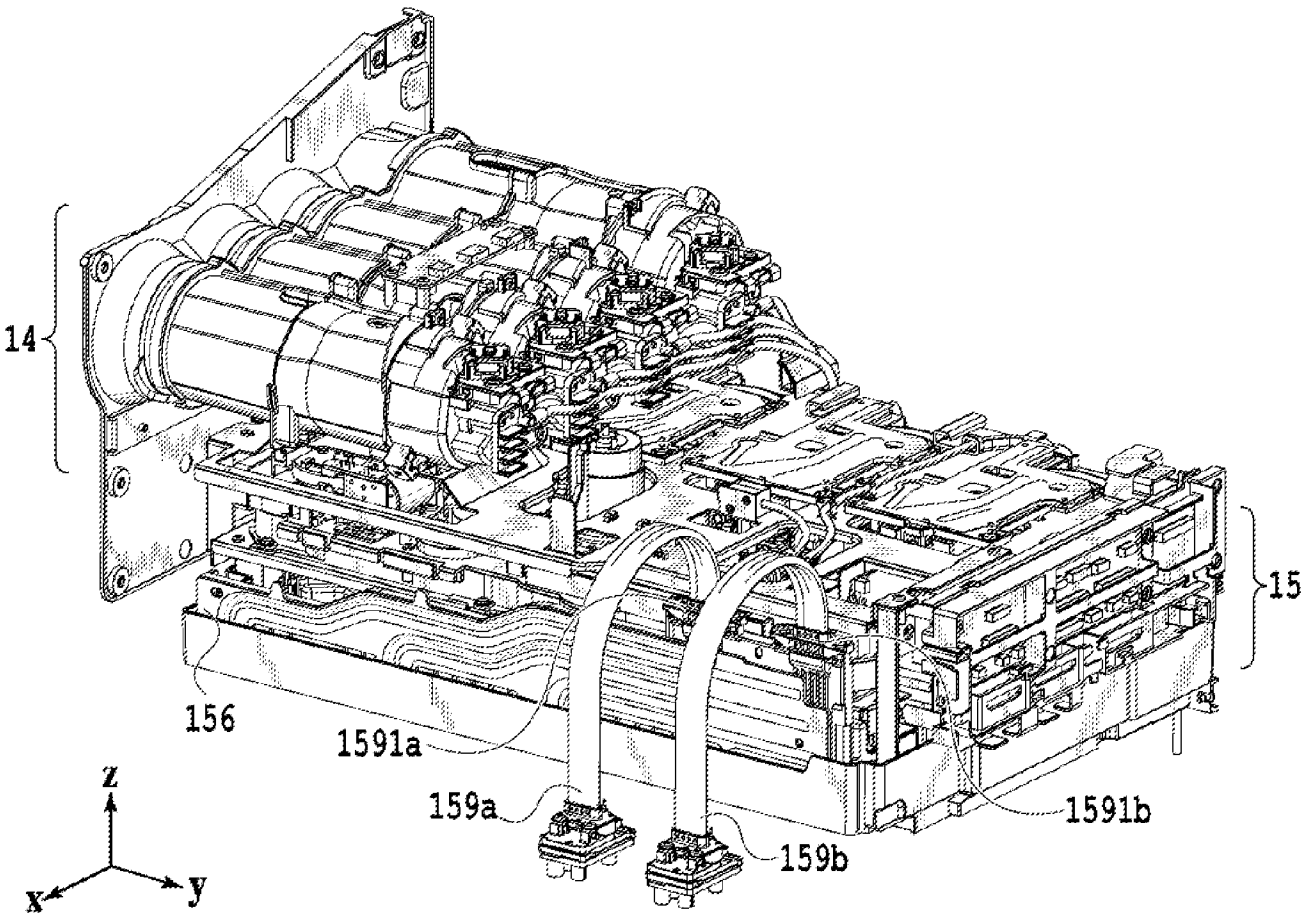
FIG. 13 is a perspective diagram explaining arrangement of the flow path concentration plate in the ink tank unit and the ink supply unit.
Figure 14A:
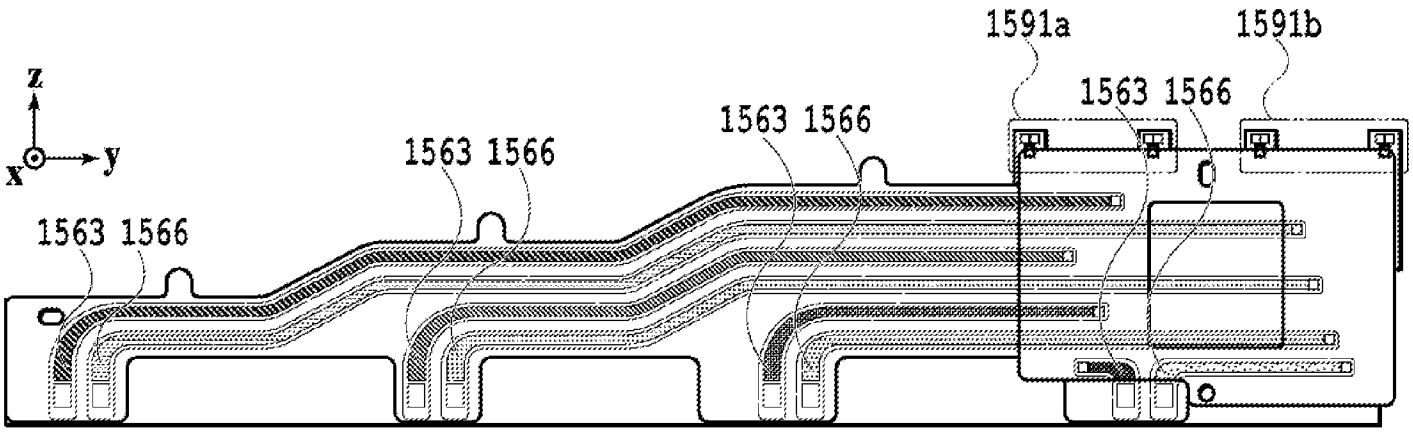
FIG. 14A and FIG. 14B are diagrams explaining an internal configuration of the flow path concentration plate.
Figure 14B:
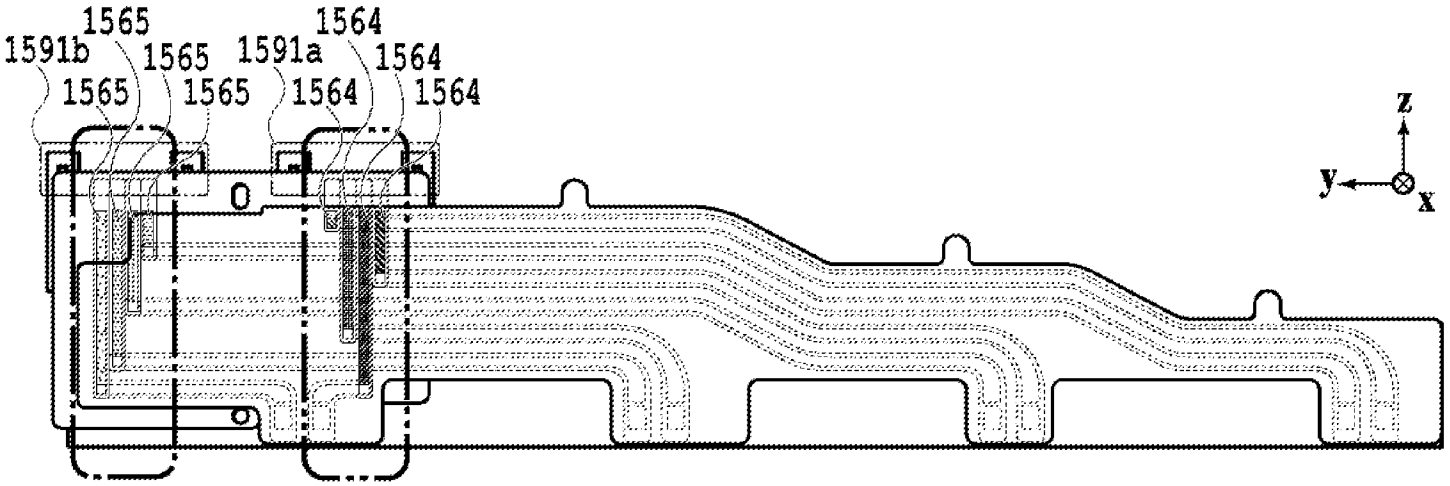

FIG. 13 is a perspective diagram showing the arrangement of the flow path concentration plate 156 in the ink tank unit 14 and the ink supply unit 15. FIG. 14A and FIG. 14B are diagrams showing the internal configuration of the flow path concentration plate 156. In detail, FIG. 14A is a diagram showing flow paths that guide ink approximately along the y-direction in a case where the flow paths are viewed from the −x-direction. On the other hand, FIG. 14B is a diagram showing flow paths that guide ink along the z-direction in a case where the flow paths are viewed from the +x-direction. In FIG. 13, FIG. 14A, and FIG. 14B, the film member on the surface of the flow path concentration plate 156 is made transparent and the flow paths are made visible.

The flow path concentration plate 156 extending in the yz-direction is a plate for concentrating the flow paths relating to ink within the sub unit 150 for each ink color and connecting to the linking tubes 159*a* and 159*b*. The flow path concentration plate 156 has a third connection portion 1591*a* that connects with the linking tube 159*a* and a third connection portion 1591*b* that connects with the linking tube 159*b*. The flow paths formed within the ink flow path plate 152 in the sub unit 150 for each ink color are connected with the flow paths formed within the flow path concentration plate 156 via the second connection portion 1561.

As shown in FIG. 14A and FIG. 14B, within the flow path concentration plate 156, eight flow paths that guide ink are formed. The details of the eight flow paths are four supply flow paths that convey each color ink from the sub tank 151 for each ink color to the print head 8 and four recovery flow paths that convey each color ink from the print head 8 to the sub tank 151 for each ink color. Each of the four supply flow paths within the flow path concentration plate 156 is configured by a portion (referred to as a supply flow path 1563) that guides ink approximately along the y-direction and a portion (referred to as a supply flow path 1564) that guides ink along the z-direction. Similarly, each of the four recovery flow paths within the flow path concentration plate 156 is configured by a portion (referred to as a recovery flow path 1565) that guides ink along the z-direction and a portion (referred to as a recovery flow path 1566) that guides ink approximately along the y-direction.

With the configuration such as this, ink flows in the order of the sub tank 151→the supply flow path within the ink flow path plate 152→the supply flow path 1563→the supply flow path 1564→the linking tube 159*a*→the print head 8 and the ink is supplied to the print head 8. Then, the ink not used for printing flows in the order of the print head 8→the linking tube 159*b*→the recovery flow path 1565→the recovery flow path 1566→the recovery flow path within the ink flow path plate 152 and recovered to the sub tank 151.

Effect of the Present Embodiment, Modification Example and the Like

As explained above, the plurality of the ink flow path plates 152 having the same configuration is arranged side by side in the y-direction, facing in the same direction and the flow path concentration plate 156 is arranged across the plurality of the ink flow path plates 152 (see FIG. 9A). Further, in each sub unit 150, the first function part group 153 that acts on the flow paths of ink within the ink flow path plate 152 is arranged so as to be included within a space demarcated by the ink flow path plate 152 and the flow path concentration plate 156. Specifically, the first function part group 153 is arranged above the ink flow path plate 152 and between the sub tank 151 and the flow path concentration plate 156.

As above, in the present embodiment, the flow paths within the ink supply unit 15 are implemented by using the two kinds of plates, that is, the plurality of the ink flow path plates 152 extending in the xy-direction and the flow path concentration plate 156 extending in the yz-direction. By designing the configuration such as this, it is made possible to make effective use of the space demarcated by the plurality of the ink flow path plates 152 and the flow path concentration plate 156 while suppressing the flow path from becoming large in the xy-direction of the flow path, compared to a case where only the plates extending in the xy-direction are used. Consequently, it is possible to make compact the ink supply unit and as a result of this, the printing apparatus 1 by preventing the ink supply unit 15 from becoming large in the xy-direction. Further, by arranging the first function part group 153 within the space (chamber) demarcated by the plurality of the ink flow path plates 152 and the flow path concentration plate 156, it is made possible to protect the first function part group 153.

In the explanation given previously, the example is explained in which the first function part group 153 that acts mainly on the flow path is arranged within the range of the space demarcated by the ink flow path plate 152 and the flow path concentration plate 156, but another part may be arranged. For example, a motor, not shown schematically, for driving a drive valve and a pump, or a drive mechanism, such as a gear, may be arranged within the space.

Further, in the explanation given previously, the case is explained where the printing apparatus 1 includes the sub unit for each ink color (that is, the sub units of cyan (C), magenta (M), yellow (Y), and black (Bk)). However, the number of sub units is not limited to four. It is possible to apply the present invention to a printing apparatus including any number (however, two or more) of sub units. For example, a case is considered where two kinds of ink, that is, a first ink and a second ink are made use of. In this case, the printing apparatus according to the present invention includes a first ink flow path plate for the first ink, a second ink flow path plate for the second ink, and a flow path concentration plate that concentrates a supply flow path and a recovery flow path for the first ink and a supply flow path and a recovery flow path for the second ink.

According to the present invention, it is possible to provide an ink jet printing apparatus whose compactness is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-066376 filed Mar. 30, 2018, which is hereby incorporated by reference herein in its entirety.

What is claimed is:

1. An ink jet printing apparatus comprising:

an ink tank for each ink color that stores ink to be supplied to a print head that ejects ink;

an ink flow path plate for each ink color, the ink flow path plate having a supply flow path that guides the ink supplied from the ink tank to the print head;

a flow path concentration plate in which is concentrated the supply flow path for each ink color and which guides the ink between the ink flow path plate and the print head, the flow path concentration plate being inclined with respect to the ink flow path plate; and one or a plurality of function parts provided within a space demarcated by both of (a) the ink flow path plate and (b) the flow path concentration plate, the one or a plurality of function parts being configured to act on the supply flow path inside the ink flow path plate.

2. The ink jet printing apparatus according to claim 1, wherein in a case where the direction of gravity is taken to be a z-direction, a direction in which the ink flow path plate for each ink color is arrayed to be a y-direction, and a direction perpendicular to the z-direction and the y-direction to be an x-direction, the ink flow path plate extends in the xy-direction and the flow path concentration plate extends in the yz-direction.

3. The ink jet printing apparatus according to claim 1, wherein the ink flow path plate and the flow path concentration plate are perpendicular to each other.

4. The ink jet printing apparatus according to claim 1, wherein the flow path concentration plate is used in common for all ink colors.

5. The ink jet printing apparatus according to claim 1, wherein the flow path concentration plate is arranged longitudinally with a connection portion with the ink flow path plate being located below.

6. The ink jet printing apparatus according to claim 1, wherein each flow path concentrated in the flow path concentration plate includes (a) a portion that guides the ink approximately in parallel to a direction in which the ink flow path plate for each ink color is arrayed and (b) a portion that guides the ink along the direction of gravity.

7. The ink jet printing apparatus according to claim 1, wherein the space is located above the ink flow path plate in the direction of gravity and between the ink tank and the flow path concentration plate.

8. The ink jet printing apparatus according to claim 1, further comprising: a drive mechanism for driving the one or the plurality of function parts provided within the space.

9. The ink jet printing apparatus according to claim 8, wherein the one or the plurality of function parts includes at least one of:

a drive valve for opening and closing a flow path by the drive mechanism;

a differential pressure valve that opens and closes a flow path in a case where a predetermined pressure is produced in a first direction;

a first pump that is arranged in the supply flow path and driven by the drive mechanism; and a buffer chamber.

10. The ink jet printing apparatus according to claim 1, wherein the ink flow path plate has a recovery flow path that guides the ink recovered from the print head to the ink tank, the recovery flow path for each ink color being concentrated in the flow path concentration plate.

11. The ink jet printing apparatus according to claim 10, further comprising:

a first linking tube that guides the ink supplied from the ink tank via the flow path concentration plate to the print head; and a second linking tube that guides the ink recovered from the print head to the flow path concentration plate, wherein inside the first linking tube, the supply flow path for each ink color is sectioned, which is connected with the supply flow path inside the flow path concentration plate and inside the second linking tube, the recovery flow path for each ink color is sectioned, which is connected with the recovery flow path inside the flow path concentration plate.

12. The ink jet printing apparatus according to claim 10, further comprising:

a drive mechanism for driving the one or the plurality of function parts provided within the space, wherein the one or the plurality of function parts includes a second pump that is arranged in the recovery flow path and driven by the drive mechanism.

13. The ink jet printing apparatus according to claim 1, wherein the ink flow path plate is provided below the ink tank in the direction of gravity.

14. An ink jet printing apparatus comprising:

a first ink tank that stores a first ink to be supplied to a print head;

a second ink tank that stores a second ink to be supplied to the print head, the print head being able to eject the first ink and the second ink;

a first ink flow path plate having a supply flow path for the first ink;

a second ink flow path plate having a second supply flow path for the second ink;

a flow path concentration plate in which are concentrated the first supply flow path and the second supply flow path, the flow path concentration plate being inclined with respect to the first ink flow path plate and the second ink flow path plate; and one or a plurality of function parts provided for each of the first ink flow path plate and the second ink flow path plate, which is provided within a space demarcated by both of (a) the first ink flow path plate and the second ink flow path plate and (b) the flow path concentration plate, the one or a plurality of function parts being configured to act on the first supply flow path inside the first ink flow path plate.

15. The ink jet printing apparatus according to claim 14, wherein in a case where the direction of gravity is taken to be a z-direction, a direction in which the first ink flow path plate and the second ink flow path plate are arrayed to be a y-direction, and a direction perpendicular to the z-direction and the y-direction to be an x-direction, the first ink flow path plate and the second ink flow path plate extend in the xy-direction and the flow path concentration plate extends in the yz-direction.

16. The ink jet printing apparatus according to claim 14, wherein the first ink flow path plate and the flow path concentration plate are perpendicular to each other, and wherein the second ink flow path plate and the flow path concentration plate are perpendicular to each other.

17. The ink jet printing apparatus according to claim 14, wherein the flow path concentration plate is arranged longitudinally with a connection portion with the first ink flow path plate and a connection portion with the second ink flow path plate being located below.

18. The ink jet printing apparatus according to claim 14, wherein the space is located above the first ink flow path plate and the second ink flow path plate in the direction of gravity and between the first ink tank and the second ink tank, and the flow path concentration plate.

19. The ink jet printing apparatus according to claim 14, further comprising:

a drive mechanism for driving the one or the plurality of function parts provided within the space.

20. The ink jet printing apparatus according to claim 19, wherein the one or the plurality of function parts includes at least one of:

a drive valve for opening and closing a flow path by the drive mechanism;

a differential pressure valve that opens and closes a flow path in a case where a predetermined pressure is produced in a first direction;

a first pump that is arranged in the supply flow path and driven by the drive mechanism; and a buffer chamber.

* * * * *